US007721364B2

(12) United States Patent
Pearson

(10) Patent No.: US 7,721,364 B2
(45) Date of Patent: May 25, 2010

(54) REMOTE INDOOR KITCHEN

(76) Inventor: Brian Pearson, 1414 Sutterville Rd., #22, Sacramento, CA (US) 95822

( * ) Notice: Subject to any disclaimer, the term of this patent is extended or adjusted under 35 U.S.C. 154(b) by 587 days.

(21) Appl. No.: 11/395,771

(22) Filed: Mar. 31, 2006

(65) Prior Publication Data

US 2007/0226899 A1 Oct. 4, 2007

(51) Int. Cl.
*A47K 1/04* (2006.01)

(52) U.S. Cl. ..... 4/631; 4/679; 4/696; 312/228

(58) Field of Classification Search ..... 4/625–627, 4/630, 631, 653, 680, 679, 696; 312/228–228.1, 312/294, 169, 204; 108/11–14; D23/284, D23/287

See application file for complete search history.

(56) References Cited

U.S. PATENT DOCUMENTS 3,915,529 A 10/1975 Bernier
4,002,383 A * 1/1977 Holloway, Jr. ..... 312/228
5,205,002 A * 4/1993 Sage-Passant ..... 4/653
5,636,654 A * 6/1997 Helm ..... 137/15.01
6,330,852 B1 * 12/2001 Williams ..... 99/408
6,349,715 B1 2/2002 McBroom
6,427,259 B1 8/2002 Cawthon
6,959,460 B2 11/2005 Patterson
7,448,405 B2 * 11/2008 Shores ..... 4/696

* cited by examiner

*Primary Examiner*—Tuan N Nguyen
(74) *Attorney, Agent, or Firm*—Law Offices of David M. Lang; David M. Lang

(57) ABSTRACT

A remote indoor kitchen coupled to existing water and drainage resources where the water and drainage lines may be uncoupled utilizing quick-connect couplers and the remaining fast remove portion of the line is removed. Water leakage is prevented through shutoff valves upstream and downstream of the fast remove portion. Optionally, couplers containing integrally disposed, one-way valves in the female members, are located at either end of the fast remove portion of the line to prevent water leakage. Preferably, the supply tubing is resilient and predisposed to coil making removal simpler. Water drainage is accomplished through valveless couplers and preferably by assisted by pump. The kitchen assembly includes a frame with preferably collapsible lower legs, at least one sink, a planar surface, storage drawers, a faucet, a spray nozzle, a backsplash with an electrical outlet. Optionally the sink includes a garbage disposal, mounted oven, and a protective plastic overlay.

5 Claims, 10 Drawing Sheets

REMOTE INDOOR KITCHEN

FIELD OF THE INVENTION

This invention relates to a portable kitchen apparatus and method for providing remote use of kitchen appliances utilizing a homeowner's existing drainage and water supply resources.

DESCRIPTION OF THE RELATED ART

Kitchen remodeling requires the often prolonged removal of a homeowner's existing sink, countertop, cabinetry, and dishwashing facilities for the purpose of allowing the installer access to the kitchen for remodeling efforts. As remodeling can take months, the absence of a kitchen sink can force the homeowner to wash dishes, prepare meals, and the like, in a less-than-ideal location within the home—often within the family bathroom. This has a substantial negative impact on the homeowner's quality of life and often requires a family to postpone much-needed remodeling efforts to avoid the hardships associated with using the family bathroom as a makeshift kitchen.

To solve this problem, a portable sink or kitchen may be used. Currently, there are several free-standing sink assemblies disclosed in the prior art—many of which designed for outdoor or camping use. Many utilize tank systems for providing water and collecting drainage. For example, Bernier, U.S. Pat. No. 3,915,529, teaches a compact field kitchen wherein a water container is placed on an uppermost portion of the apparatus and water, by gravity feed, travels from the holding container through internal plumbing to a faucet. Patterson, U.S. Pat. No. 6,959,460, teaches a washing sink with a container for fresh water disposed adjacent to the sink.

Sinks utilizing a water storage container, while proper for short-term or occasional use, are less useful during home-remodeling where a relatively high volume of water is required, and where the sink will be used frequently. Further, water supply systems employing a water tank or container must be periodically checked and refilled with fresh water—this requires a time commitment by the homeowner and involves the substantial physical burden of manually changing tanks holding large volumes of water. Further indoor heating of tank or container systems is difficult and may be hazardous—particularly an indoor use of a portable kitchen intended for outdoor use. Lastly, free-standing drainage systems, which empty greywater into a tank, must be continuously monitored to evaluate the level of drainage waste to prevent a dreaded overflow event. This requires an additional burden on the homeowner who is forced to not only continually bring in heavy, fresh water, but remove equally heavy, dirty drainage water. Further, such waste-water may contain food particles and debris and eventually take on a foul, obnoxious odor and itself become a source of misery if not hazardous.

Systems adapted for providing a fixed connection between a sink and water supply and drainage systems are described in the prior art, however, these devices are typically adapted for outdoor use. For example McBroom, U.S. Pat. No. 6,349,715 B1, teaches a mobile cooking device with inlet and outlet hoses fluidly connected to the unit. Likewise, Cawthon, U.S. Pat. No. 6,427,259, teaches an outdoor portable sink capable of connection to an existing water supply.

The prior art devices are ill-suited for indoor use during a kitchen remodel. Semi-permanent connections between a free-standing sink and the homeowner's kitchen water and drainage lines are impractical because they do not allow individuals installing the new kitchen proper access to the kitchen area without the interference of cumbersome drainage and water lines in the installer's way.

Accordingly, a need exists for an indoor, portable, remote kitchen with a coupling system permitting quick connection between a homeowner's existing water and drainage resources. What is further needed is a system that is easy-to-use and minimizes or eliminates water seepage, leakage, or spilling from water and drainage lines during the coupling and uncoupling process. What is also needed is a unit that is quickly collapsible and mobile permitting easy storage and transportation.

SUMMARY OF THE INVENTION

It is, therefore, a primary object of the present invention to solve the above described drawbacks associated with using prior art devices during kitchen remodeling efforts. Accordingly, one object of the invention is to improve a homeowner's quality of life by providing a portable kitchen in a remote location. It is a further object of this invention to provide a kitchen apparatus in a remote location where the homeowner's water and drainage resources are employed to bring fresh hot and cold water and provide drainage. A further object of the present invention is to provide a portable kitchen featuring water and drainage lines that may be rapidly coupled to provide the homeowner water and drainage and uncoupled when the contractor begins work and the lines are underfoot.

It is a further object of the present invention that said water and drainage lines prevent water and drainage leakage during the coupling and uncoupling process. It is a further object of the invention to provide homeowners with a variety of locations to couple to water and drainage lines such that any location on the property providing a water or drainage resource may be used (e.g. a laundry room). It is an added object of this invention to provide a variety of locations suitable for interposition of quick connect couplers which permit the invention to be tailored to a variety of home-remodeling situations. It is further still an object of this invention to provide a varied option of hoseline styles to fit the homeowner and contractor's needs. It is yet another object of this invention to provide access to existing drainage resource safely, in such a way as to avoid sewer gases from entering the home through use of a properly coupled a waste-water pump or conventional P trap system where circumstances permit.

It is a further object of the invention that the remote kitchen will be collapsible permitting easy portability within the house and efficient storage when not in use. In a further embodiment of the invention, the remote kitchen provides an electrical outlet preferably utilizing a receptacle-type ground fault circuit interrupter (GFCI) to provide a safe means to connect a hot-plate, microwave, blender, toaster, or other kitchen appliance to enhance the utility of the remote location to the homeowner. It is a further object of the invention to provide a safe indoor remote kitchen which meets residential single-dwelling and multi-dwelling building and safety codes.

DETAILED DESCRIPTION OF THE PREFERRED EMBODIMENTS AND ALTERNATIVE EMBODIMENTS

Figure 1:
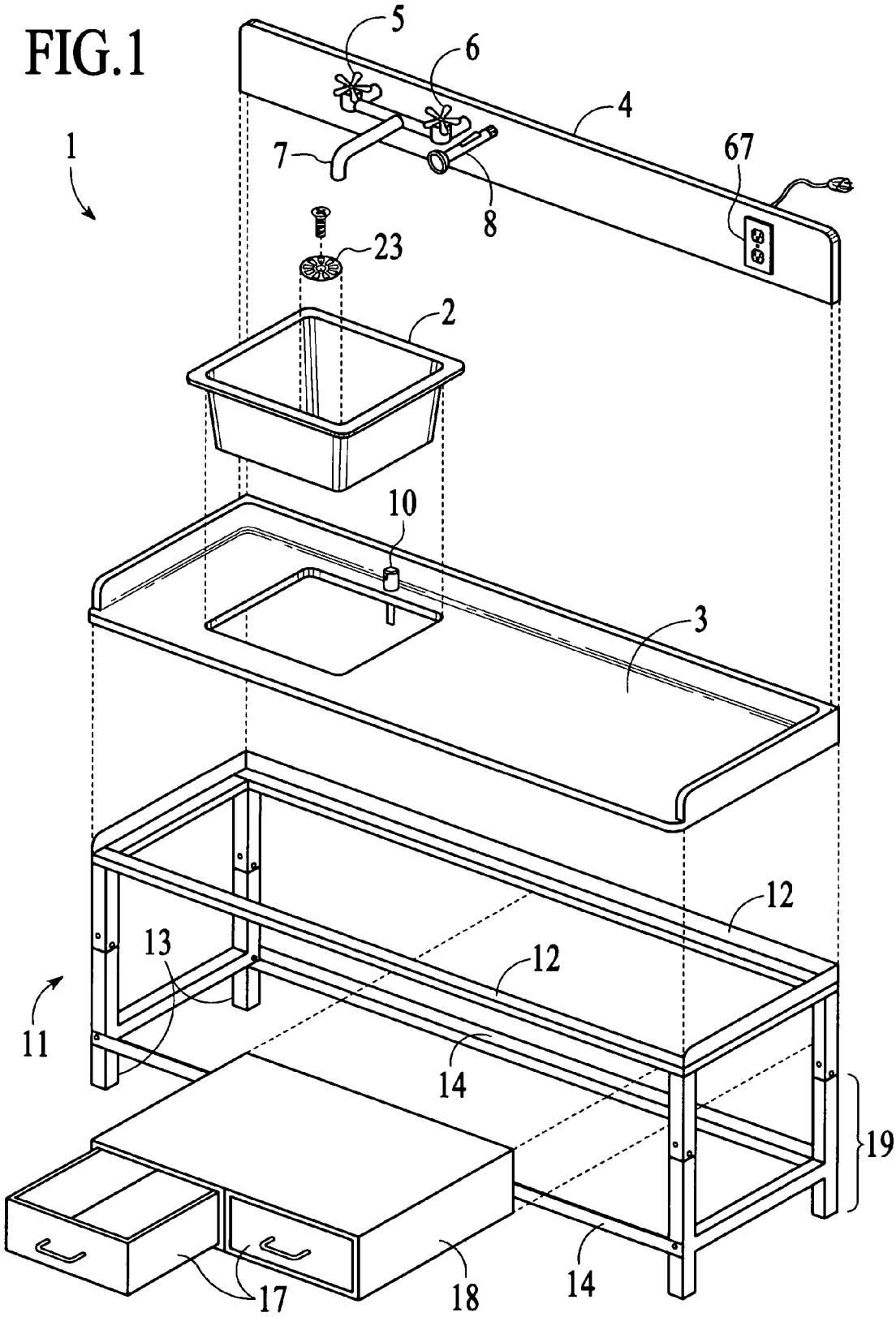
FIG. 1 is an exploded perspective view of the present invention showing the sink, framework, faucet, and storage features.
Figure 2:
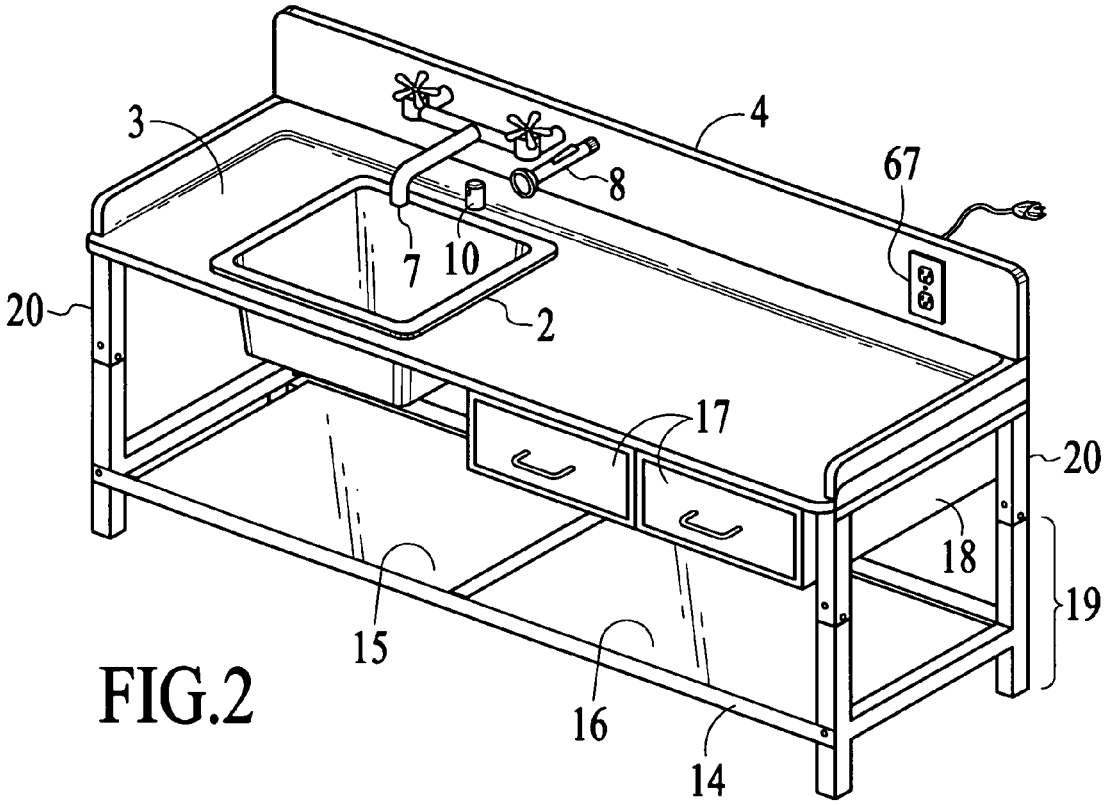
FIG. 2 is a perspective view of the present invention.

The following description is presented to enable any person skilled in the art to make and use the invention, and is provided in the context of particular applications and their requirements. Various modifications to the preferred embodiment will be readily apparent to those skilled in the art, and the generic principles defined herein may be applied to other embodiments and applications without departing from the spirit and scope of the invention. Thus, the present invention is not intended to be limited to the embodiment shown, but is to be accorded the widest scope consistent with the principles and features disclosed herein. As shown in FIG. 1, the present invention involves a collapsible portable kitchen generally referenced 1 with a sink 2 defined so as to permit a drain 22 to be disposed therein. A drainage screen 23 covers the drainage aperture. The sink can be formed of stainless steel, acrylic (including plastic), or rubber, as well as other materials commonly used for sinks including: ceramic quartz, enameled cast iron, enameled steel, and granite.

Figure 6:
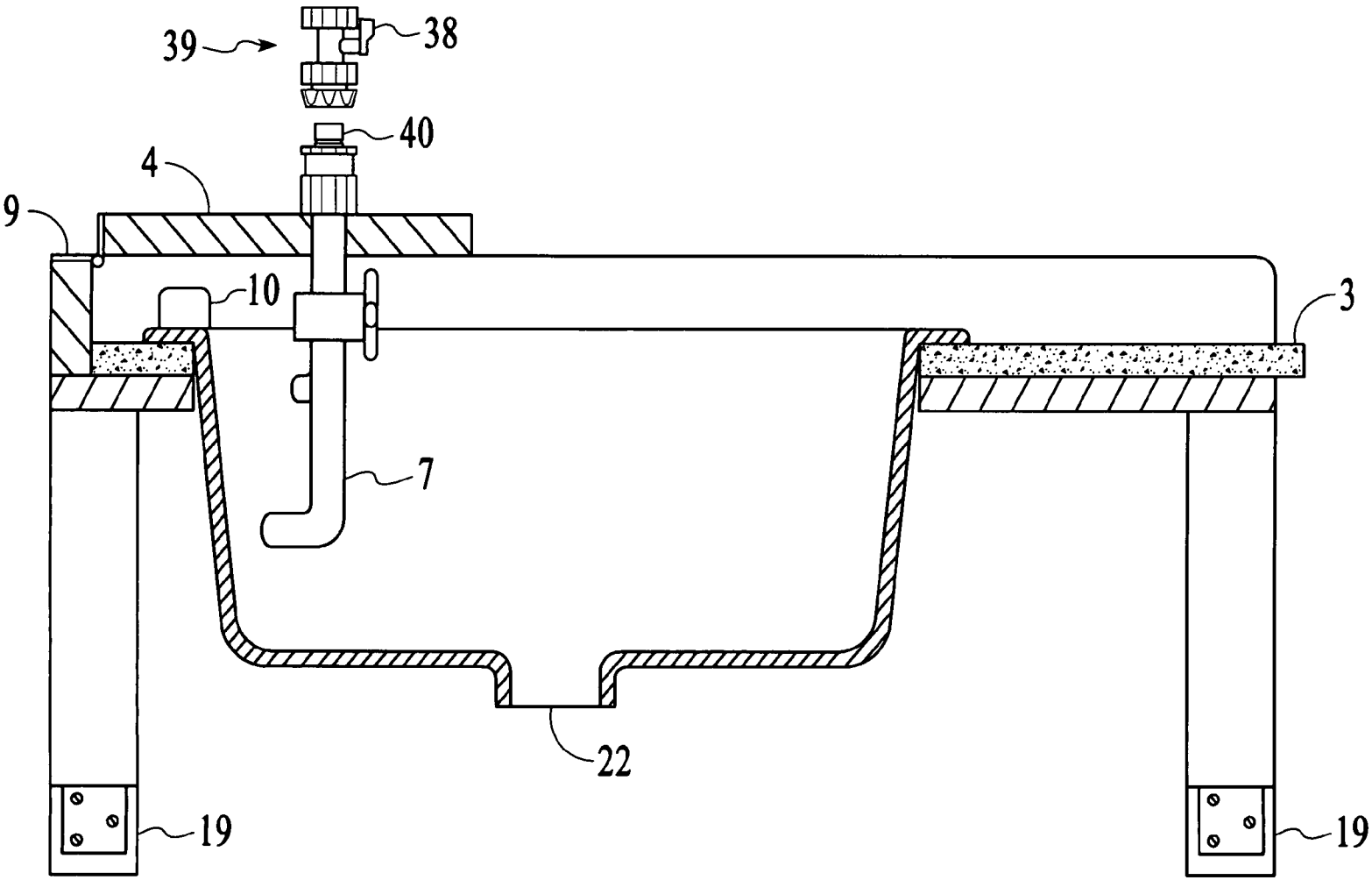
FIG. 6 is a cross sectional view taken along line 24-24 of FIG. 5 showing the present invention folded for storage.

The sink 2 is disposed within a planar surface 3, said surface attached to a backsplash 4 which contains hot and cold water valves 5,6, a faucet 7, and a spraying nozzle 8. The backsplash 4 is coupled to the planar surface 3 by a hinge 9 or in an alternative embodiment, another coupling structure that permits open and collapsed positions. The hinge 9, illustrated by FIG. 6, is ideally lockable in open and closed positions; alternatively, an external bolt lock may be mounted on the rearmost portion of both sides of the attached backsplash 4 and engaged to lock the backsplash 4 in the upright position. An electrical outlet 67 may be mounted on the backsplash or other suitable location. A standard air gap 10 emerges through an aperture in the planar surface 3. In a preferred embodiment, the sink 2 and the planar surface 3 are formed of a single, integral plastic unit with an optional backsplash 4; any desirable surface contouring or ridges are incorporated. The planar surface 3 is mounted on a support frame 11 which, in a preferred embodiment, is comprised of an upper bracket 12 upon which the planar surface 3 rests, a plurality of legs 13, and a lower bracket 14. The supporting structure may be comprised of either a plurality of legs or a base unit which provides support for the sink.

Figure 3:
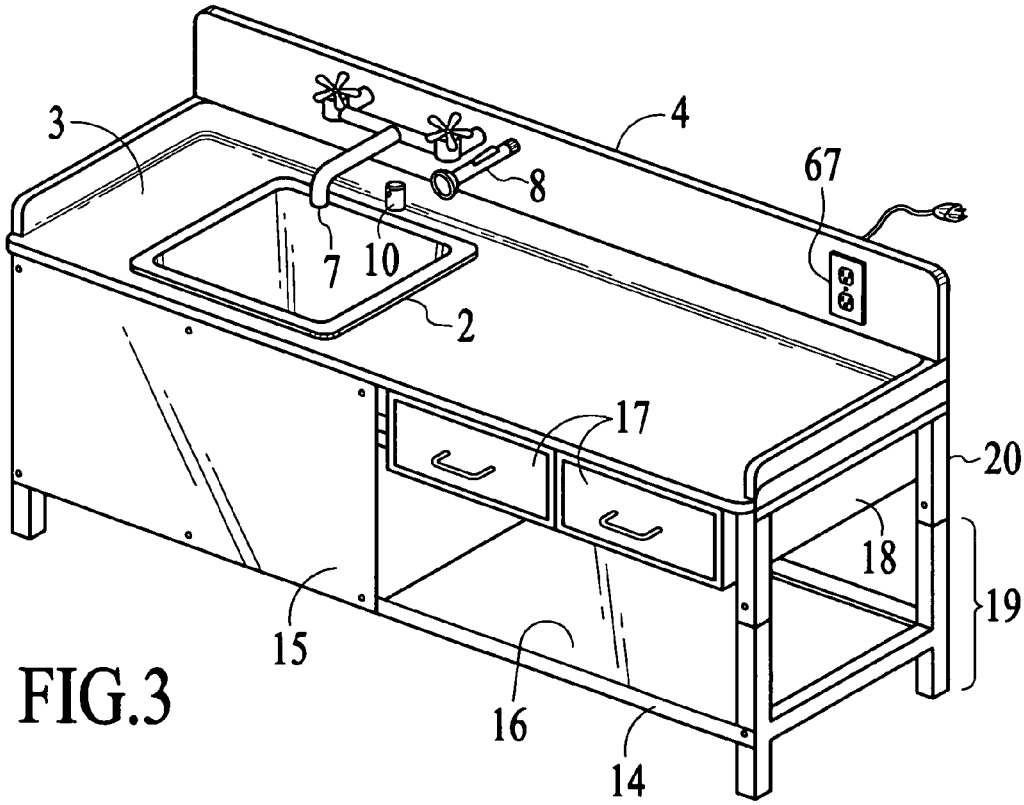
FIG. 3 is a perspective view showing optional paneling shielding the front of the sink's underside from view.

In the fully open state, FIG. 3 illustrates the lower bracket 14 is fixed in a lower position and a front panel 15 and storage panel 16 rest on the lower bracket. The front panel 15 may be vertically positioned over the lower aspect of the sink so as to shield the sink 2 and drain 22 from view. This front panel reversibly attaches to the front of the frame 11, and the addition of the front panel provides additional frame stability where lightweight metal, plastic, or wood is used for the frame. The storage panel 16 is retained on the lower bracket to provide a storage surface. Storage drawers 17 are slideably inserted within an outer housing 18, the housing being connected to the frame 11. In the preferred embodiment, the legs 13 are comprised of a lower-leg assembly 19 hingeably coupled to an upper-leg assembly 20.

Figure 4:
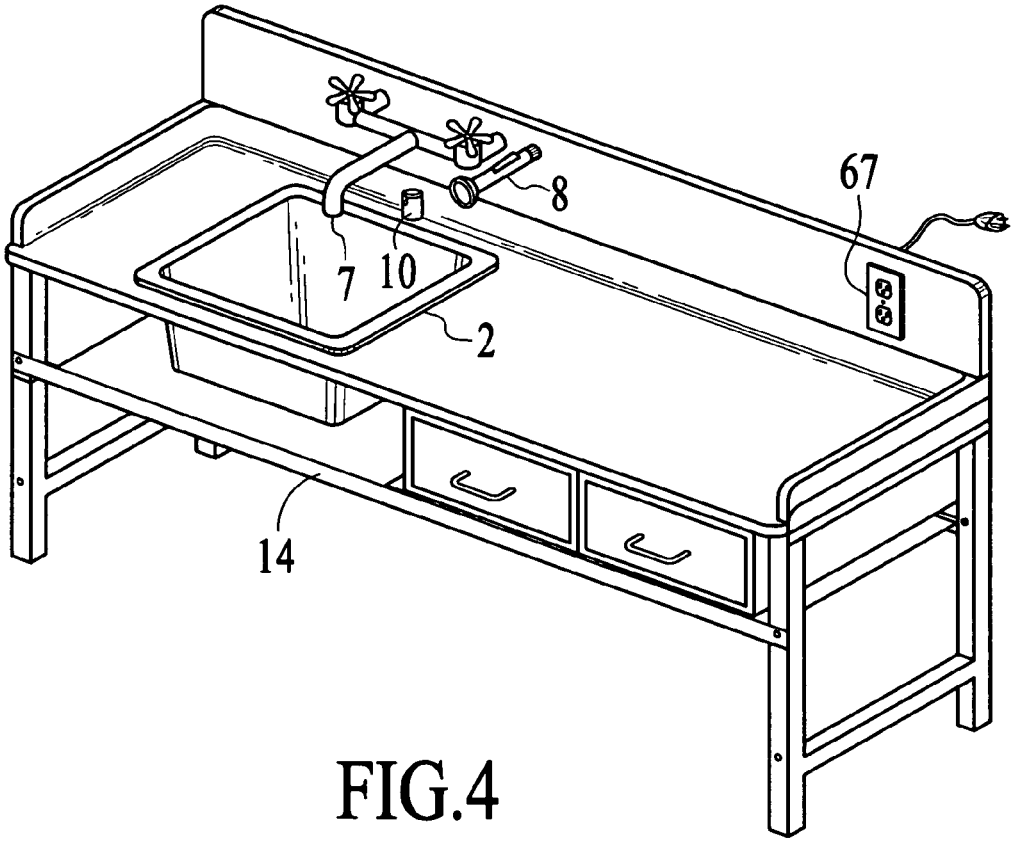
FIG. 4 is a perspective view showing optional elevation of an adjustable lower bracket.
Figure 5:
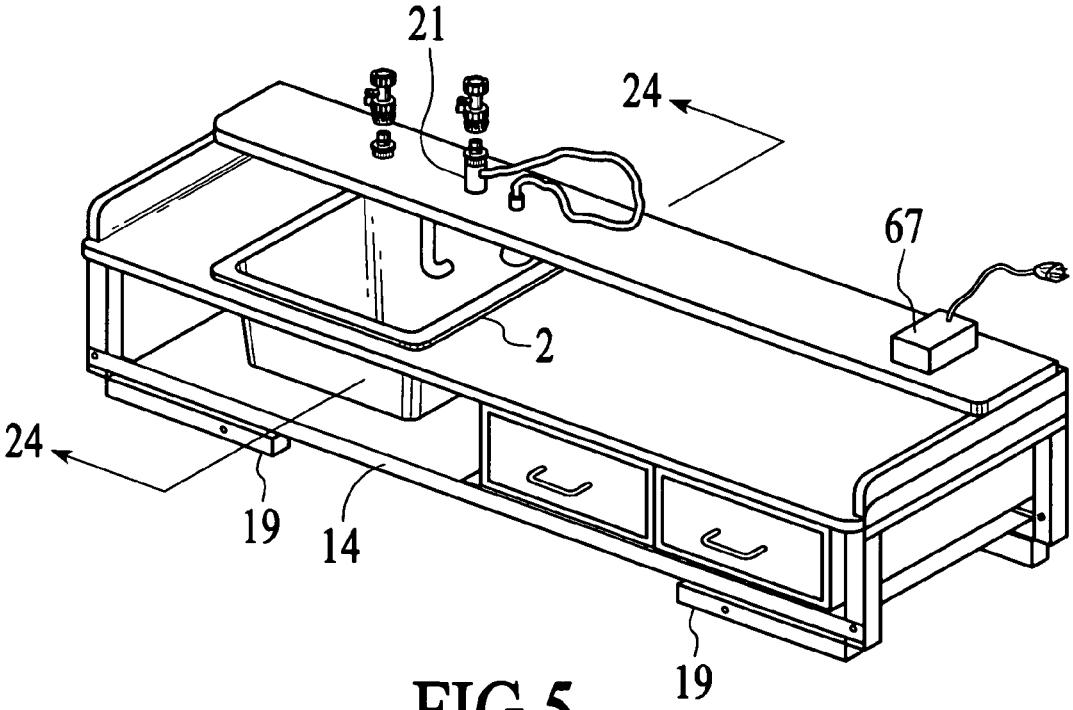
FIG. 5 is a perspective view showing the present invention folded for storage.

In the fully collapsed state, as illustrated in FIG. 5, and FIG. 6, the lower-leg assembly 19 and the backsplash 4 maximally fold inward toward the planar surface 3 with the lower bracket 14 fitted in an uppermost position. The front panel 15 and storage panel 16 are stowable on the lower bracket 14 when it is in the upper position, as illustrated in FIG. 4 and FIG. 5. In a preferred embodiment, a bolt lock may is used to keep the backsplash and the legs in the open and/or closed positions.

A conventional spray nozzle line 8 attached to the hot water inflow, or cold water inflow from a tee 21 downstream of a male member of the quick disconnect (FIG. 5). The downstream end of the spray nozzle 8 is shaped and designed such that it may be reversibly fitted snugly into the drainage aperture 22 in the sink 2. A drainage cover 23 fits securely over the drainage aperture 22. The end of the spray nozzle 8 also functions like a plunger allowing water to be driven down the drain for cleaning and clearing the sink's contents. Optionally, a conventional garbage disposal is mounted in a standard fashion under the drainage aperture 22 and the drainage cover 23 omitted. Optionally, an oven is mounted underneath the upper bracket 12 and above the lower bracket 14 (FIG. 7).

Illustrated in the collapsed state, FIG. 6 demonstrates a cross-sectional view of the present invention taken along line 24-24 of FIG. 5 showing backsplash 4 coupled to the planar surface 3 preferably by locking hinge, maximally folded forward toward the planar surface 3. The lower leg assemblies 19 are coupled, preferably by hinge, to the upper leg assemblies 20 and the lower legs may be folded inwardly such that they rest parallel to the planar surface 3. The lower legs are preferably lockable in open and collapsed positions. In one embodiment, the lower bracket 14, the lower leg assemblies 19 and the frame 11 are constructed of steel; however, the support structure may be comprised of other metals, rigid plastic, or wood.

Figure 7:
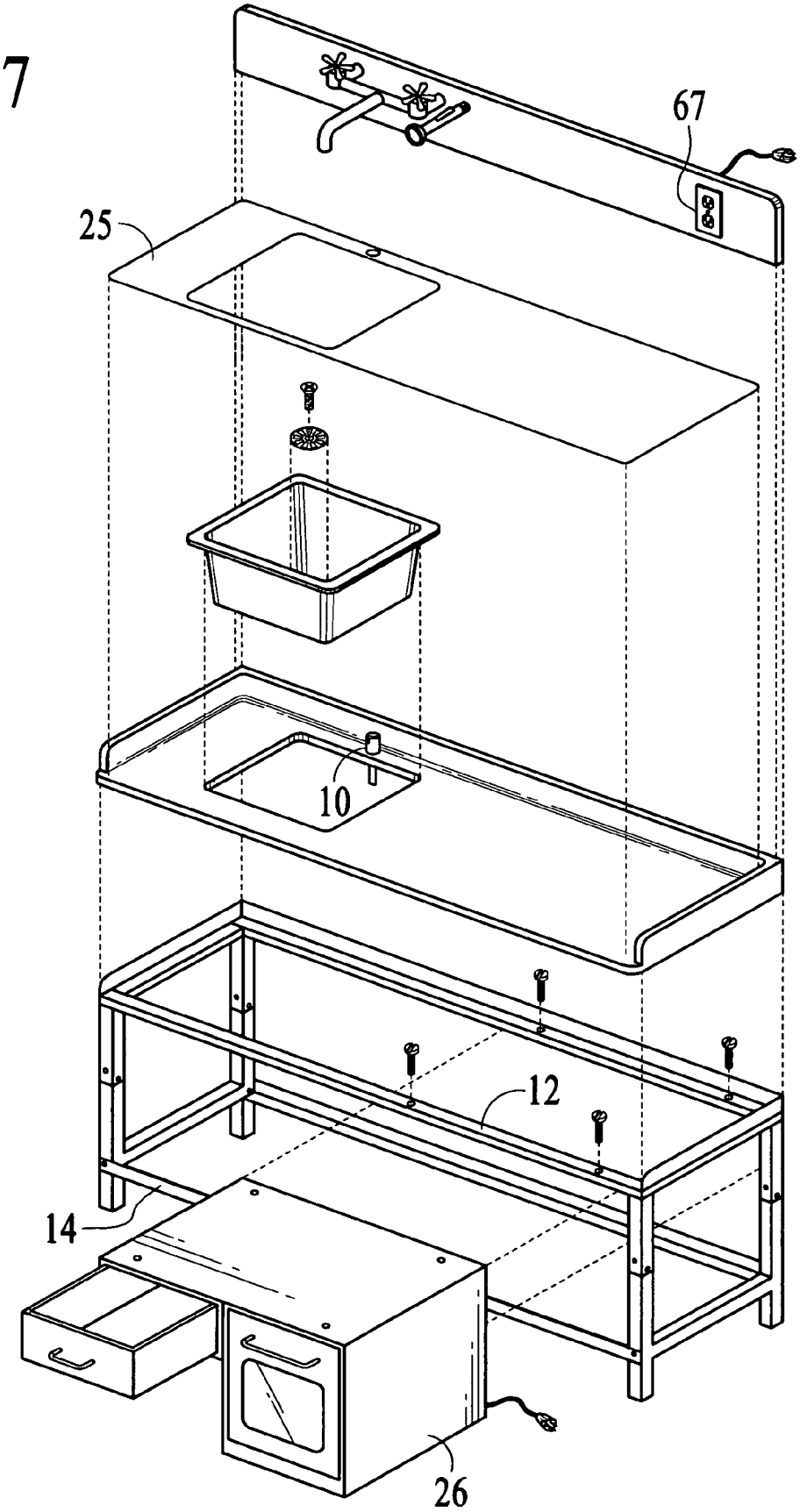
FIG. 7 is an exploded perspective view showing the sink, framework, faucet, and storage features with an optional overlay and an optional mounted oven.

Two alternative embodiments which are distinct from one another, yet, for illustrative purposes, are demonstrated together on FIG. 7. The first alternative embodiment employs a disposable countertop 25 which overlays the planar surface 3 and has pre-cut apertures corresponding the sink 2 and the air gap 10. The disposable countertop may be constructed of plastic, rubber, laminated plastic, wood, formica, or other material generally suitable for countertop surfaces. Optionally, a small oven 26 may be mounted underneath the upper bracket 12.

Figure 8:
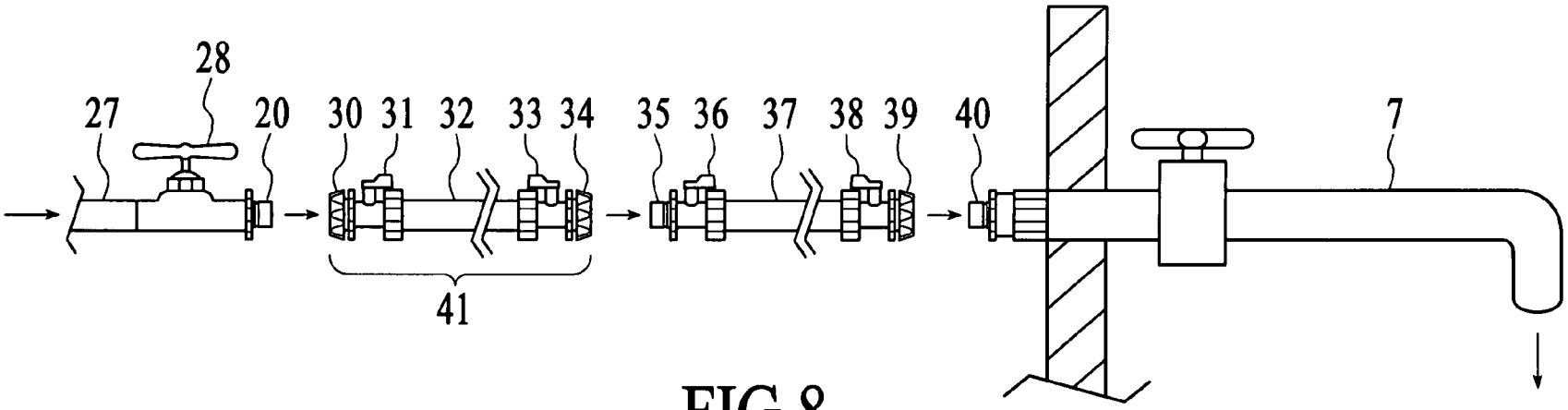
FIG. 8 is a side elevational view of the fluid supply system with a plurality of shutoff valves.

Turning now to an example water supply coupling scheme illustrated by FIG. 8, following the flow from upstream to downstream, a water supply line 27, extends from the homeowner's wall, and is coupled to a first shutoff valve 28. This valve may be the homeowner's native shutoff valve, or the native valve may be removed and another valve added. The shutoff valves are coupled to a first male member of a quick-connect coupler assembly 29 which reversibly engages a downstream first female quick-connect member 30, coupled to a downstream second shutoff valve 31. The second valve 31 is coupled to a removable section of hot and cold waterlines 32. The waterlines are coupled to a third shutoff valve 33 which is followed by a second female member of a quick-connect coupler assembly 34 and reversibly engages a downstream second male quick-connect member 35. The male member 35 is coupled to a fourth shutoff valve 36 which is coupled to the continuing hot and cold waterlines 37, and terminates in a fifth shutoff 38. The fifth shutoff is coupled to a third female member of a quick-connect coupler assembly 39 and reversibly engages a downstream third male quick-connect member 40 coupled to either (a) the hot water valve 5 and thereafter the faucet 7 or (b) a tee 21 (supplying water to the nozzle 8), the cold water valve 6, and thereafter the faucet 7. That portion of the above assembly from the first female member 30 to the second female member 34 comprises the "fast remove" portion of the water supply system 41.

The above water coupling scheme is designed to permit rapid breakdown of the water supply system and a method permitting rapid removal of waterlines that are in the kitchen, underfoot, and burden on a contractor performing a home remodel. That portion of the water supply designed to be rapidly removed is defined as a "fast-remove waterline" 41 and is comprised of the first female member 30, the second shutoff valve 31, the removable portion of the hot and cold waterlines 32, the third shutoff 33 and the second female member 34. This portion of the line may be quickly removed from the area at the beginning of a contractor's workday and rapidly reattached at the termination of the workday, when water flow to the remote sink is again desired. The male and female members may be rapidly connected and disconnected in standard fashion, and the shutoff valves closed prior to disconnect, and opened after connection is made.

It should be noted that the enumeration of shutoff valves and male and female members of the quick-connect assembly is for illustrative purposes only; any number of valves, and quick-connect assemblies may be utilized without departing from the spirit and scope of the invention. In certain circumstances, such as, for example, where the water supply is from a homeowner's washer and dryer fixtures is desired instead of utilizing kitchen connectivity, the fast-remove portion of the waterline may be located anywhere downstream from a portion of the waterline not requiring rapid removal (e.g. the line in the washroom is permissible, but a line from the washroom door in the hallway to the sink is the "fast remove" portion).

Further, the male and female orientation of the couplers is arbitrary, and the invention may be practiced without regard to order of the male and female quick-connect members; the above male/female orientation and enumeration is for illustrative purposes only. The minimum diameter of the waterlines is variable and dependent on circumstances. For illustrative purposes, waterlines may be one half-inch in diameter; drainage lines one-one and one-half inches.

Figure 9:
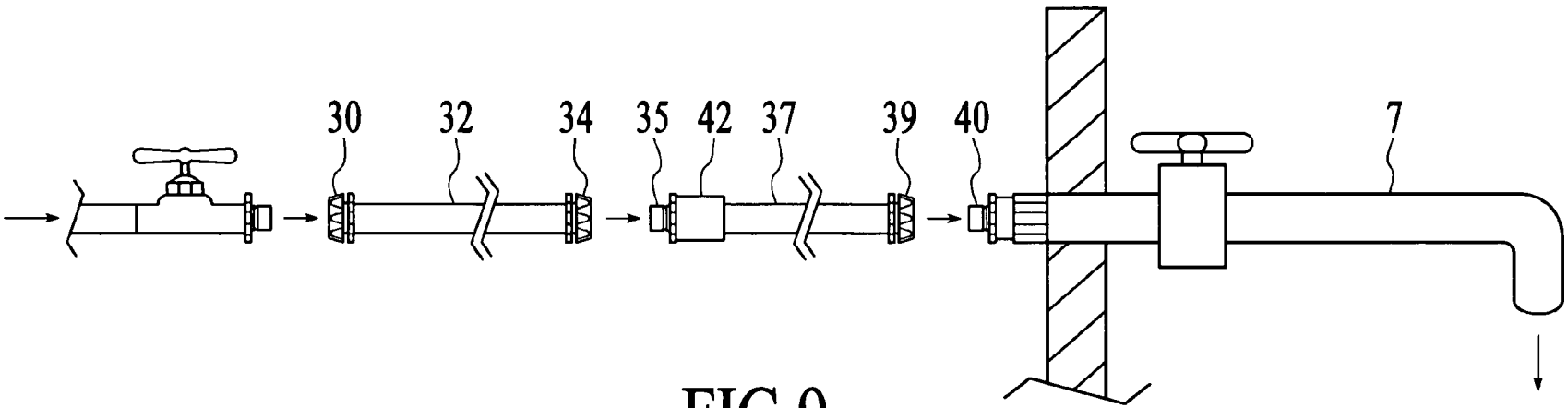
FIG. 9 is a side elevational view of an alternative embodiment containing only one shutoff valve.

An alternative embodiment shown in FIG. 9 omits most shutoff valves, and thus permits faster breakdown and removal of the fast-remove portion. In this alternative embodiment, the first female quick-connect member 30, is coupled directly to the fast-remove portions of hot and cold waterlines 32 which are connected directly to the second female member of a quick-connect coupler assembly 34. The second female member reversibly engages a downstream second male quick-connect member 35 which is coupled to a fluid check valve 42 which is coupled to the continuing hot and cold waterlines 37, and terminates in a third female member of a quick-connect coupler assembly 39 and reversibly engages a downstream third male quick-connect member 40 coupled to the faucet 7. In this embodiment, all but the first shutoff valves are omitted. In this alternative embodiment, the fluid check valve (e.g. the Flomatic Enviro Check series as a non-limiting example) provides unidirectional flow of water and prevent backflow during removal of the fast-remove portions 32 of the waterlines. When the system is uncoupled at the first 30 and second 34 coupling point, the line 32 may be quickly removed, and water will be exert pressure against the first and second female member valves, thereby closing the valve in the uncoupled state preventing water retained within the line 32 from spilling out. Importantly, in the alternative embodiment, the female member of the quick connect assembly has an integrally mounted valve preventing leakage of water from the fast remove portion, and accordingly, female-line-female orientation is required. Use of a male member is permissible, but would require the incorporation of a one-way fluid check valve into the fast-remove portion (not shown).

Figure 10:
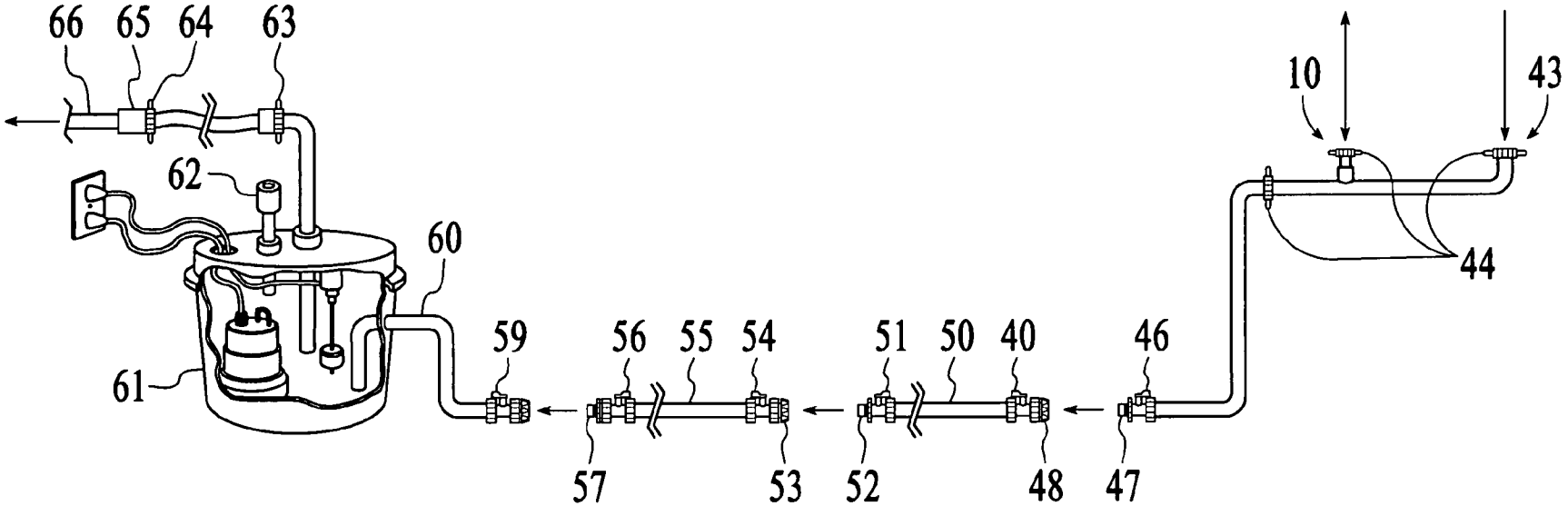
FIG. 10 is a side elevational view of the drainage system.

With regard to the drainage system shown by FIG. 10, from the drain 22, drainage tubing 43 comprised of hose or piping extends downwardly and connects to a conventional air gap 10 which extends upwardly behind the sink 2, passes through an aperture in the planar surface 3, and terminates behind the sink. Downstream, quick-union connectors 44 affix the drainage and air gap hose or piping to the downstream drainage line 45 which is coupled to a first drainage shutoff valve 46. A first male member of a quick-connect coupler 47, reversibly engages the first female member of the quick-connect coupler 48 which is itself coupled to a second shutoff valve 49. Downstream, a drainage line 50 is coupled to a third shutoff valve 51 which is coupled to a second male member 52 that reversibly engages a second female member 53. Downstream further, the second female member 53 is coupled to a fourth shutoff valve 54 said fourth valve coupled to a drainage line 55. The line is coupled to a downstream fifth shutoff valve 56 and a third male member 57. Further downstream, the third male member 57 reversibly engages the third female member 58, said female member coupled to a sixth shutoff valve 59. The sixth shutoff is coupled to hose or piping draining downstream to a conventional drainage pump 61. Tubing extends upwardly from the pump and is outfitted with an air check valve 62. Downstream from the pump 61 drainage material is pumped through one or more sections of piping coupled by quick-union connectors 63, 64 and leading to a downstream second air check valve 65 and finally coupled to the homeowner's drainage system 66. As illustrated by FIGS. 10-13, and described above, the shutoff valves are located inline with respect to drainage line 50 and are located immediately upstream and downstream of the various coupling points. Shutoff valves are located at the terminal ends of that portion of line located between coupling points, and the terminal end of the remaining lines, as illustrated by FIGS. 10-13 and described above.

The drainage system may be broken down in a variety of ways. For example, the third, 51, fourth, 54, fifth 56, and sixth 59 shutoff valves may be closed and the line uncoupled at the second male/female member 52, 53 and the third male/female member 57, 58. The section of the drainage system from the second female member 53 to the third male member 57 constitutes the "fast-remove" section of the drainage system, and may be removed leaving the second male member 52 in an upstream location, and the third female member 58 in the at the downstream location. Alternatively, the system may be broken down at the second male/female member 52/53 and at the second quick union connector 64. This more comprehensive breakdown would permit removal of the drainage pump and all piping, hosing, and couplings downstream of the second male member 52 and upstream of the second check valve 65.

Regarding the pump 61, conventional pumps contain an air intake valve through which sewer gases will escape from the pump into the environment. To alleviate this problem, tubing of proper dimensions is placed in the pump's air-intake and coupled to an air check-valve 62. A second solution is to attach a ventilation line from the tubing to the facility's ventilation system. It should be noted that while the pump is demonstratively illustrated downstream of the fast-remove portion of the drainage system, it may be operatively placed anywhere along the drainage system. In a specific alternative embodiment, the pump 61 is placed in close proximity to the support frame 11 or may be stored underneath the sink 2. The homeowner's individual circumstances will determine the optimal location of the pump.

Figure 13:
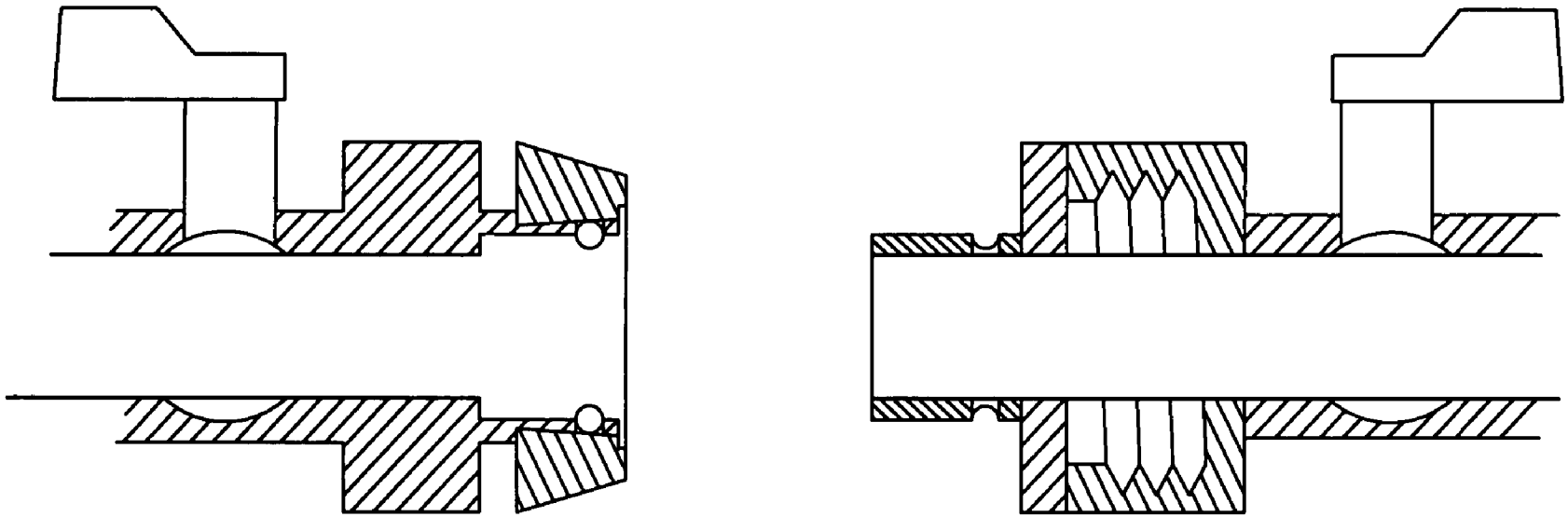
FIG. 13 is a horizontal cross sectional enlarged view of an exemplar ball-and-sleeve drainage coupler demonstrating the absence of an integrally mounted valve.

In a preferred embodiment, couplers incorporated in the drainage system are specifically designed to be non-valved, as illustrated generally by FIG. 13 depicting an example ball-and-sleeve quick connect coupler. The absence of an integrally disposed valve within the quick-connect female member reduces resistance and maximizes drainage. Of note, there is no tapering or narrowing of the male member as it engages the female member. This ensures that the cross-sectional area is no smaller than the male member. Further, the non-valved shutoff is ideally 1.0-1.5 inches in diameter, but may be larger. Likewise, the tubing and piping is ideally 1.0-1.5 inches in diameter, but may be larger where circumstances favor utilization of a larger albeit more cumbersome drainage system. Smaller tubing may be used in situations where sullage is likely to consist of liquids, or where a short drainage line is required, or where the pumping means employed will provide sufficiently brisk drainage despite the smaller diameter.

A variety of alternative drainage system embodiments and variations exist. As with the water supply system, enumeration of shutoff valves and male and female members of the quick-connect assembly is arbitrary and for illustrative purposes only; any number of valves, and quick-connect assemblies may be utilized without departing from the spirit and scope of the invention.

Moreover, as with the water supply system, in one alternative embodiment, threaded couplers, with and without shutoff valves, may be employed in lieu of quick connect couplers. It should be noted that couplings may be employed in or used in combination with quick-connect couplers such that it is possible to practice the invention with any combination of quick-connect couplers and threaded couplers utilized at any location. Male and female portions of the threaded couplers, like the quick-connect couplers, may be employed without regard to upstream-downstream orientation. With regard to the couplings used in the present invention, it should be noted that couplings may be employed in or used in combination with quick-connect couplers such that it is possible to practice the invention with any combination of quick-connect couplers and threaded couplers utilized at any location. Male and female portions of the threaded couplers, like the quick-connect couplers, may be used in any particular upstream-downstream order.

Further, the couplings systems employed may include double-shutoff, single-shutoff, non-valved. In a preferred embodiment, such valves are comprised of poppet-type single-shutoff valves; these eliminate water leakage during coupling and uncoupling of the fast-remove portions of the waterlines. In alternative embodiments, other valves may be used including, but not limited to: ball valves, rotary and sliding spool-type valves, swing-type valves.

Additional engageable coupling mechanisms having mateable portions are known in the prior art and specifically considered for use in this invention include: ball-and-sleeve, cam-and-groove, threaded, push on, flush-face, and twist/bayonet. The invention may be practiced with any hydraulic coupling permitting the flow of water. Likewise, a variety of coupling geometries are available, and given the low viscosity of water, the invention may be practiced with virtually any such geometric configuration. For example, where circumstances require an appreciable bend in the waterline or drainage line, an elbow configuration may be employed to accomplish this objective while maintaining a method to quickly remove a portion of the waterline or drainage line. Where waterlines will be moved regularly, a swivel connector may be employed to prevent line kinking or twisting.

Heavy-duty coupling, swivel connectors, flush-face connectors, and sleeve lock connectors all may be employed as dictated by the need of the particular circumstances of the homeowner or contractor. Further, varied valving/coupling options are known in the prior art and many relate to high temperature uses, uses of fluids other than water, and valving fluids under high pressure. Any such valves and/or coupling, not defeating the purpose of the present invention, may be practiced and used.

The specific layout of the piping and drainage lines are provided for illustrative purposes only and may be tailored to suit the particular circumstances. Additionally, the system need not connect to the homeowner's drainage line; drainage material may be collected elsewhere, and ventilation accomplished through direct outdoor access. In an alternative embodiment, drainage pump 61 may be omitted and a P-trap utilized to permit gravity drainage where situations where reasonably brisk drainage is possible (i.e. drainage access point below the level of the sink's drain, and taking into account standard properties of fluid resistance and gravity).

Figure 11:
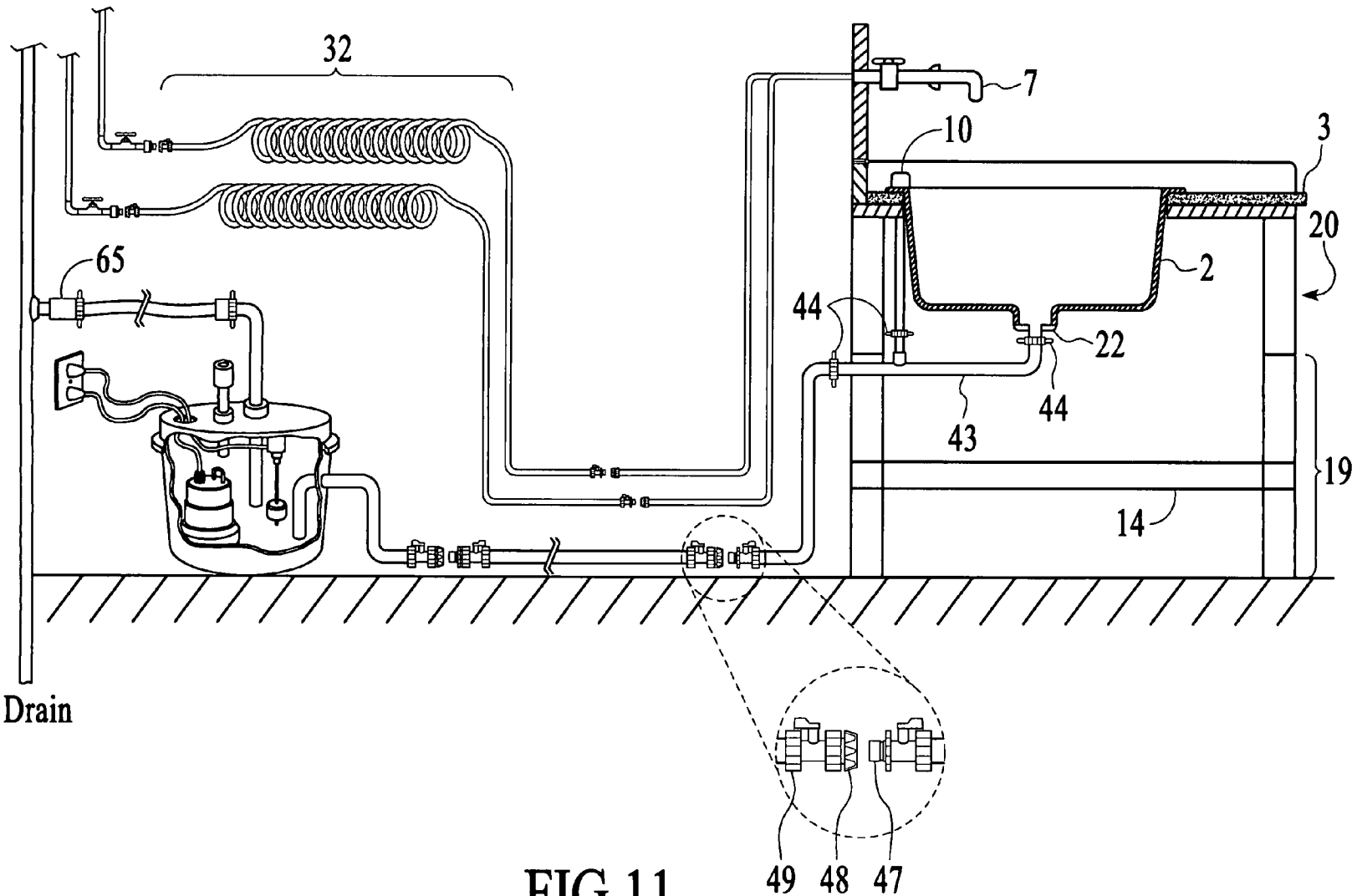
FIG. 11 is a side elevational view of the fluid supply and drainage coupling schemes featuring coiled tubing with partial enlargement depicting a quick-connect drainage coupler with shutoff valves, an optional terminal coupling scheme, and further illustrating a drainage pump in perspective.
Figure 12:
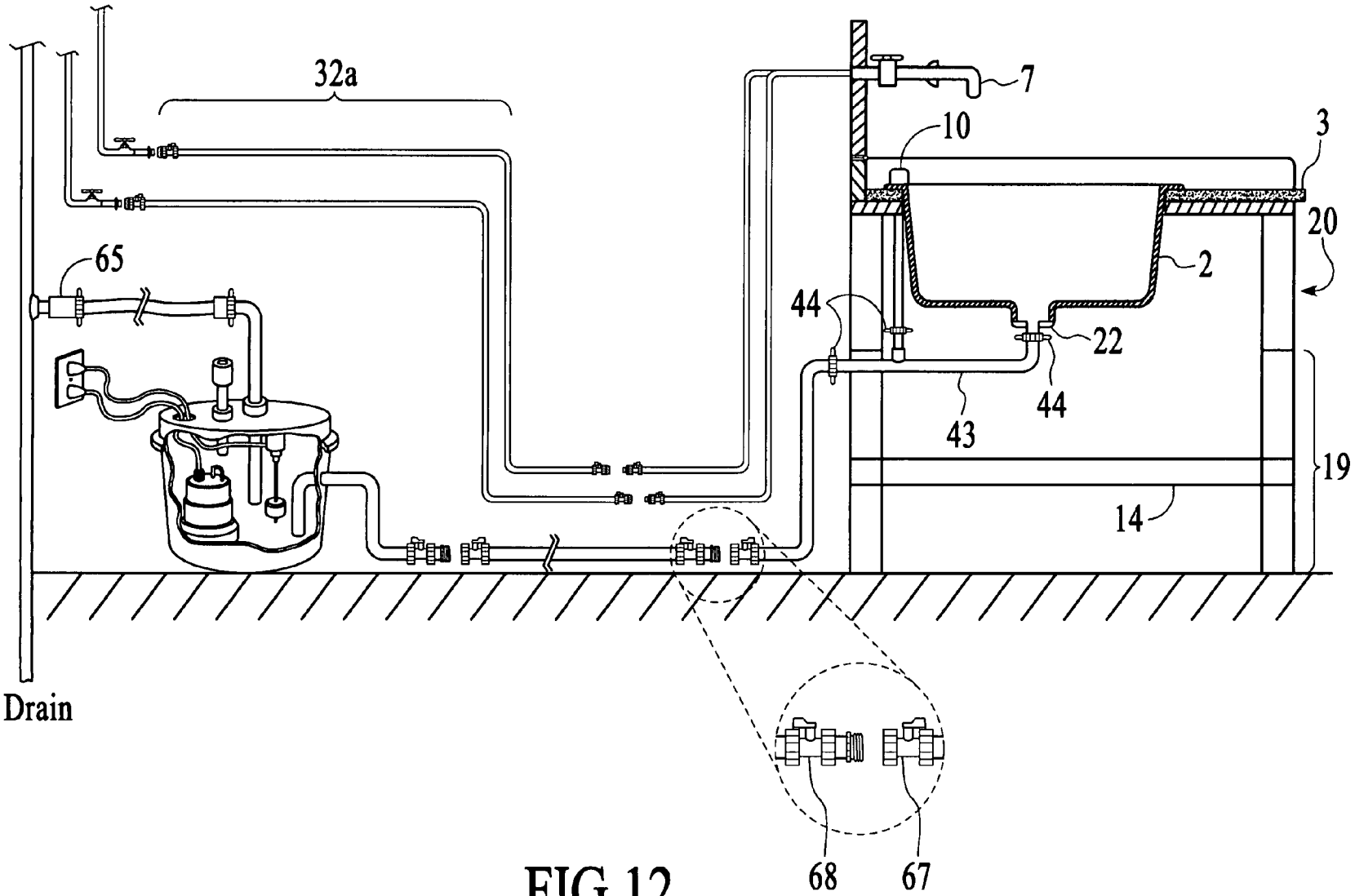
FIG. 12 is a side elevational view of the fluid supply and drainage coupling schemes featuring alternative embodiments of straight tubing with partial enlargement depicting a threaded drainage coupler with shutoff valves and further illustrating a drainage pump in perspective.

FIG. 11 demonstrates a preferred embodiment, where the fast-remove portion of the waterline 32 is formed of a resilient material such that the lines have a tendency to assume a preformed coiled shape 43. Use of resilient coiled tubing facilitates quick removal from the area and permits convenient storage. In an alternative embodiment, the downstream lines are conventional waterlines and have no special features with regard to resiliency 32*a*.

The present invention also includes a method for providing a rapidly removable fluid supply system comprising the following steps: (a) coupling a first section of hose to an existing water supply; (b) coupling said first section to a first coupling point; (c) coupling said first coupling point to a removable line; (d) coupling the downstream end of said removable line to a second coupling point; (e) establishing flow of said fluid when desired; (I) halting fluid when flow is no longer desired; (g) uncoupling points at said first coupling point; (h) uncoupling points at said second section; and (i) removing the uncoupled portion of the fluid supply line from the area.

Likewise, the drainage system also provides a method for providing a rapidly removable drainage system comprising the following steps: (a) coupling a hosing or piping to a drain; (b) coupling said hosing or piping to a first drainage coupling point; (c) coupling said first drainage coupling point to a removable drainage line; (d) coupling the downstream end of said removable drainage line to a second drainage coupling point; (e) establishing drainage flow when drainage desired; (I) halting said drainage flow when drainage is no longer desired; (g) uncoupling points at said first coupling point; (h) uncoupling points at said second section; and (i) removing the uncoupled portion of the drainage line from the area.

A number of embodiments of the present invention have been described above. Nonetheless, it is understood and recognized that various modifications may be made without departing from the spirit and scope of the invention. Accordingly, other embodiments may be within the scope of the following claims. It is intended that all matter contained in the above description or shown in the accompanying drawings shall be interpreted as illustrative and not in a limiting sense. It is also understood that the following claims are intended to cover all generic and specific features of the invention described herein and all statements of the scope of the invention, express or implied.

I claim:

1. A removable drainage system permitting drainage from a remote kitchen apparatus comprising:

(a) at least one drainage line operatively coupled to an upstream drain and an existing drainage resource at its terminal downstream end;

(b) at least two coupling points along said line, said coupling points comprised of an engageable coupling having mateable portions, allowing uncoupling at said points and removal of that portion of said drainage line between any two coupling points wherein at least two remaining lines remain;

(c) a plurality of shutoff valves wherein said shutoff valves are located inline with said drainage line and at the terminal ends of that portion of line located between coupling points, and the terminal end of the remaining lines, wherein said shutoff valves are located immediately upstream and immediately downstream of each coupling point, wherein when any one of said engaged couplings are disengaged to their mateable portions, and where the shutoff valve located immediately upstream and immediately downstream of said mateable portion are both first closed, drainage is substantially prevented from leaking from that portion of the drainage line upstream and downstream of the coupling points.

2. The drainage system in claim 1, wherein said coupling points are a material selected from the group of couplers consisting of: ball and sleeve, threaded, cam-and-groove, push-on, twist, flush-face and bayonet.

3. The drainage system in claim 1, further comprising a pump operatively connected to said drainage line wherein said pump facilitates drainage from said upstream drain to said existing drainage resource.

4. The drainage system in claim 3, further comprising at least one rigid tube extending upwardly from said pump and connected to at least one air check valve.

5. A remote kitchen apparatus, comprising: (a) a frame having a plurality of legs; (b) a planar surface affixed to said frame wherein said planar surface is shaped to define an opening; (c) at least one sink having walls and a floor disposed within the opening of said planar surface, wherein said sink has a drainage aperture in the floor of said sink; (d) a drainage line operatively coupled to said drainage aperture; (e) at least one faucet assembly adjacent to said planar surface, wherein said assembly is operatively coupled to an existing water supply; (f) a backsplash coupled to said planar surface, or formed integrally with said planar surface, said backsplash shaped to define an aperture through which said faucet assembly passes;

a water supply system having a line operatively coupled to an existing upstream water supply system; at least two coupling points along said line; an outflow assembly connected to said line at its terminal downstream end, wherein said water supply system has a plurality of shutoff valves located upstream and downstream of each coupling point;

a removable drainage system having;

(a) at least one drainage line operatively coupled to an upstream drain and an existing drainage resource at its terminal downstream end;

(b) at least two coupling points along said line, said coupling points comprised of an engageable coupling having mateable portions, allowing uncoupling at said points and removal of that portion of said drainage line between any two coupling points, wherein at least two remaining lines remain;

(c) a plurality of shutoff valves wherein said shutoff valves are located inline with said drainage line and at the terminal ends of that portion of line located between coupling points, and the terminal end of the remaining lines, wherein said shutoff valves are located immediately upstream and immediately downstream of each coupling points, wherein when any one of said engaged couplings are disengaged to their mateable portions, and where the shutoff valve located immediately upstream and immediately downstream of said mateable portion are both first closed, drainage is substantially prevented from leaking from that portion of the drainage line upstream and downstream of the coupling point.

* * * * *